United States Patent [19]

Nozawa et al.

[11] Patent Number: 4,595,043

[45] Date of Patent: Jun. 17, 1986

[54] SHUTTER DEVICE

[75] Inventors: Nobuaki Nozawa; Koichi Kondo, both of Tokyo, Japan

[73] Assignees: Bunka Shutter Co., Ltd.; Lumitter Industry Co., Ltd., both of Tokyo, Japan

[21] Appl. No.: 621,926

[22] PCT Filed: Mar. 16, 1984

[86] PCT No.: PCT/JP84/00108

§ 371 Date: Jun. 18, 1984

§ 102(e) Date: Jun. 18, 1984

[87] PCT Pub. No.: WO84/03733

PCT Pub. Date: Sep. 27, 1984

[30] Foreign Application Priority Data

Mar. 16, 1983 [JP] Japan ..... 58-37919[U]
Mar. 16, 1983 [JP] Japan ..... 58-37920[U]
Mar. 16, 1983 [JP] Japan ..... 58-37921[U]
Mar. 16, 1983 [JP] Japan ..... 58-37922[U]

[51] Int. Cl.[4] ..... E04F 10/08
[52] U.S. Cl. ..... 160/36

[58] Field of Search ..... 160/32, 33, 35, 36, 160/220, 310

[56] References Cited

U.S. PATENT DOCUMENTS 3,280,888 10/1966 Davis ..... 160/35
4,139,042 2/1979 Watanabe et al. ..... 160/36

FOREIGN PATENT DOCUMENTS 2703512 8/1978 Fed. Rep. of Germany ..... 160/35
2744915 4/1979 Fed. Rep. of Germany ..... 160/35
2752432 6/1979 Fed. Rep. of Germany ..... 160/35

*Primary Examiner*—Ramon S. Britts
*Assistant Examiner*—David M. Purol
*Attorney, Agent, or Firm*—Bernard, Rothwell & Brown

[57] ABSTRACT

A shutter device for opening and closing an opening by ascending and descending motions of panels (2), in which the panels (2) are directly engaged with panel lift means such as a chain or the like to effect the ascending and descending motions of the panels surely and smoothly, and during storage of the panels (2), the panels (2) are folded and suspended from support rails (4).

3 Claims, 10 Drawing Figures

SHUTTER DEVICE

FIELD OF ART

The present invention relates to a shutter device and more particularly to a shutter device in which a plurality of panels are each partly engaged with panel lift means such as a chain or the like to effect panel ascending and descending motions smoothly and, during panel storage, are folded and suspended from support rails disposed above guide rails.

BACKGROUND ART

Recently, there has been proposed a shutter device in which panels are disposed on the same plane in which they are supported by guide rails, and are disposed in a mutually parallel folded fashion in a state in which they are stowed in a storage box contiguous to one end of the guide rails. Indeed this type of device has advantages, for example, the noise generated during movement of the panels is reduced, the panel width can be made large and a good external appearance is obtained. But, there have been drawbacks, for example, it is difficult to smoothly perform the folding and stowing operation into the storage box and the drawing-out operation, and a complicated driving device is needed in order to ensure smooth operations. Further, it is impossible to immediately become aware of overlapping or squeezing of panels in the guide rails.

DISCLOSURE OF THE INVENTION

The object of the present invention, in order to overcome the conventional drawbacks mentioned above, is to provide a shutter device in which a plurality of panels adapted to ascend and descend along guide rails are each partly engaged with a panel lift means and panel ascending and descending motions are performed smoothly and quietly; besides, panel squeezing and useless accidents are prevented.

BEST FORM FOR PRACTISING THE INVENTION

Figure 1:
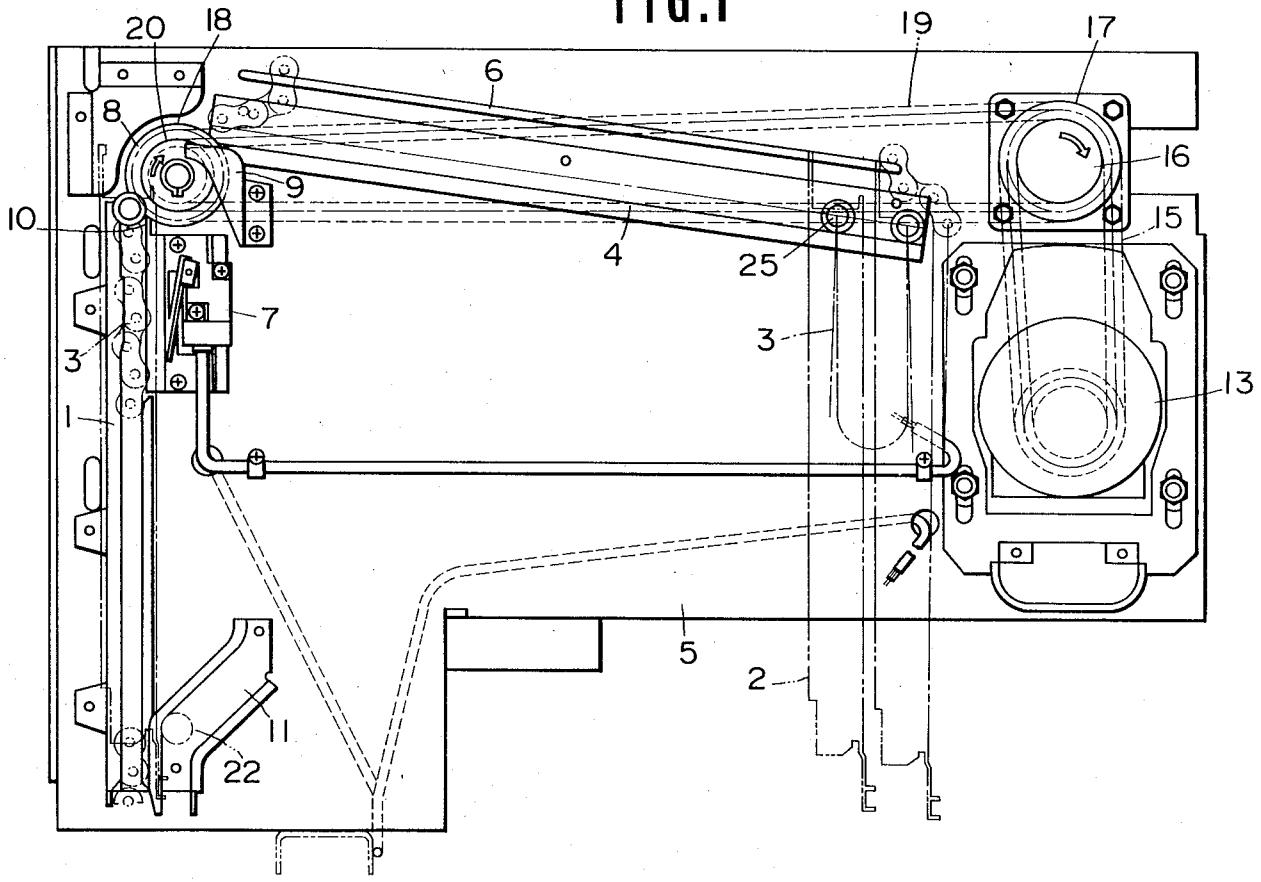
FIG. 1 is a longitudinal sectional view of an embodiment of the present invention.

An embodiment of the present invention will be described hereinunder with reference to the drawings.

The present invention has panels 2 adapted to ascend and descend along guide rails 1, driving chains 3 (panel lift means) 3 adapted to engage part of each panel 2 to let the latter perform ascending and descending motions, and support rails 4 adapted to engage part of the chains 3 to suspend and support the panels 2 in a folded state.

Figure 2:
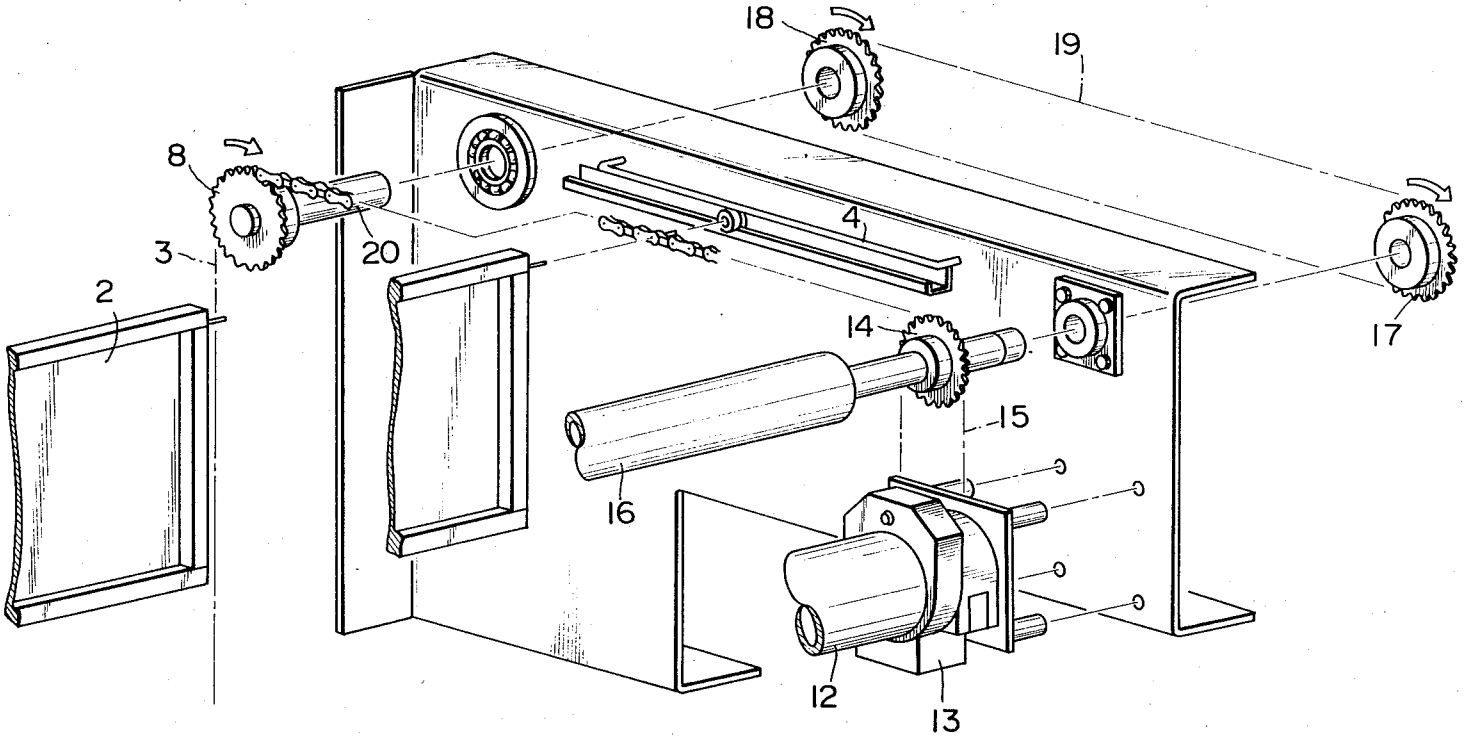
FIG. 2 is a schematic exploded perspective view of a drive portion thereof.

The guide rails 1 are disposed on both sides of an opening such as a building gateway, window or the like, and at the upper end portions thereof there is provided a storage box 5 which supports the panels 2 in a folded state as illustrated in FIGS. 1 and 2. In the vicinity of the upper end of each guide rails 1 and on the inner wall of the storage box 5 are disposed the support rail 4 and a chain top guiding rod 6 both extending downwardly slantwise. Near the upper end of each guide rail is provided a sensor (panel lift means sensor) 7 for sensing an abnormal overlapping or squeezing of the panels 2 in the guide rail 1. Further, in the vicinity of a driving sprocket 8 for driving the chain 3 there are mounted chain separating plates 9 and 10 for positively separating the chain 3 from the sprocket 8. Near the entrance of the storage box 5 are provided panel guides 11 for guiding the lower end of the panel 2 smoothly into and out of the storage box 5.

Figure 5:
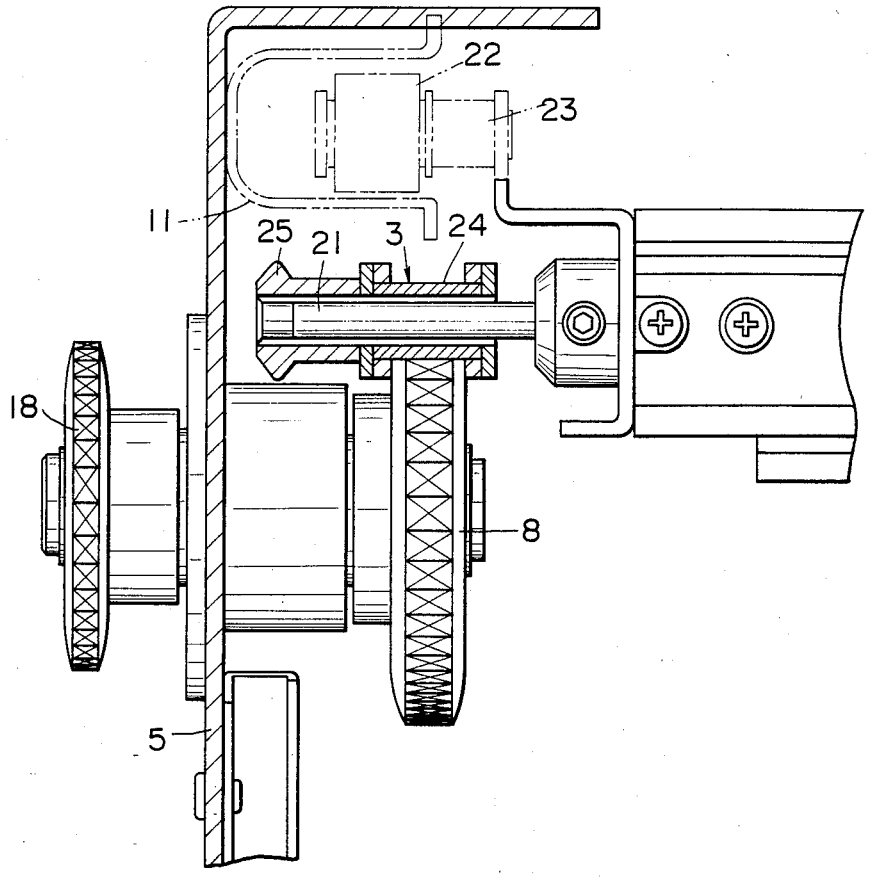
FIG. 5 is a plan view, partly in section, of an interengaged state of a driving sprocket and a driving chain.

The panel guides 11 are inclined upwardly toward the interior of the storage box 5 as shown in FIG. 1 so that rollers 22 previded at the lower end of the panel 2 engage the panel guides during ascending and descending movements as shown in FIGS. 1 and 5. Therefore, when the panel 2 ascends, the lower end of the panel 2 is conducted smoothly into the storage box 5, and when the panel 2 descends, the rollers 22 engage the panel guides, whereby the panel 2 is positively guided to the guide rails 1.

Figure 3:
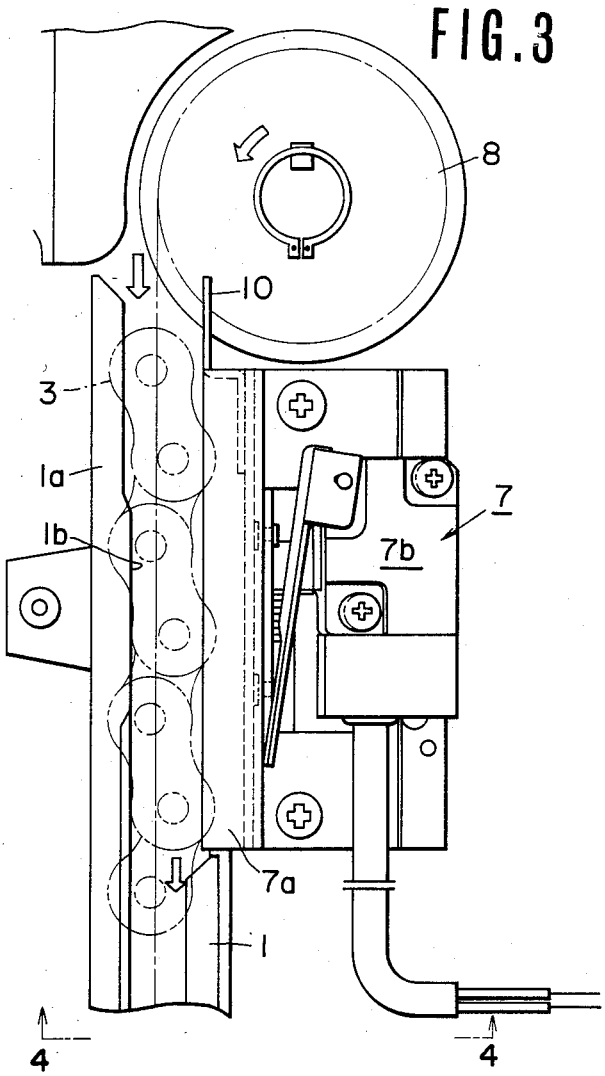
FIG. 3 is a front view of a panel lift means sensor.
Figure 4:
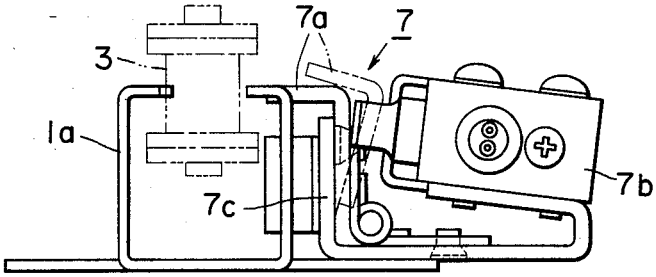
FIG. 4 is a bottom view of the panel lift means of FIG. 3 looking upwardly in the direction of the arrows 4—4 in FIG. 3.

The chain sensor 7 is urged in a direction in which the chain 3 is held between the sensor and the guide rail 1 as shown in FIGS. 3 and 4. It comprises a plate 7*a* adapted to be displaced by a pressure such as bending force of the chain 3, a limit switch 7*b* adapted to operate upon displacement of the plate 7*a*, and a stopper 7*c* for restricting the pressure displacement of the chain 3 so that the plate 7*a* may not exceed an allowable displacement of the limit switch 7*b* to thereby prevent breakage of the limit switch 7*b*. For the chain sensor 7, the guide rail 1 is provided with a chain guide plate 1*a* which surrounds the chain 3 as shown in FIGS. 3 and 4. The chain guide plate 1*a* is partially formed with a convex portion 1*b* for bending the chain 3 toward the plate 7*a* and surely urging the plate 7*a* upon occurrence of an abnormal condition.

The driving chain 3 for driving the panel 2 is disposed along the panel guide 11 and its top is loosely fitted on the chain top guiding rod 6, as shown in FIGS. 1 and 5 (the alternate long and two short dashes line portion actually exists in a position symmetrical with the position shown with respect to the panel axis, but is shown in the opposite position for convenience of illustration).

A drive portion 12 for moving the driving chain 3 up and down comprises an opening/closing machine 13, a first shaft 16 adapted to be rotated by the machine 13 through a sprocket 14 and an endless chain or belt 15, and a second shaft 20 adapted to be rotated by the first shaft 6 through sprockets 17 and 18 and an endless chain or belt 19. Mounted on the second shaft 20 is the driving sprocket 8 adapted to engage the driving chain 3 for moving the latter up and down, as shown in FIGS. 1, 2 and 5.

The panel 2 which engages the driving chain 3 rotatably and movably in the thrust direction is constituted by attaching a suitable panel plate 2*b* to a rectangular frame 2*a*. Upper frame $2c_1$ and lower frame $2c_2$ of a transverse frame 2c of the frame 2a are formed in special shapes, as shown in FIGS. 6, 7, 9 and 10.

Figure 7:
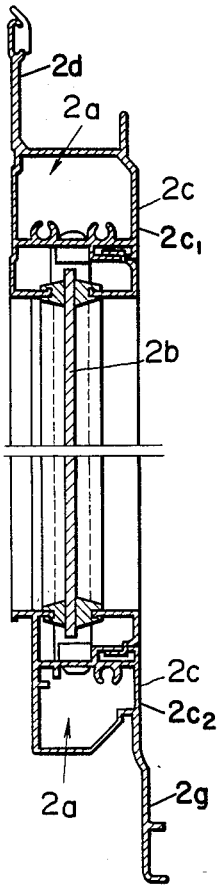
FIG. 7 is a longitudinal sectional view taken on line A—A of FIG. 6.
Figure 9:
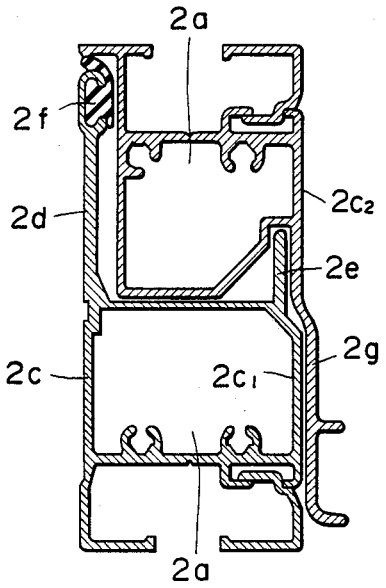
FIGS. 9 and 10 are each a longitudinal sectional view of a principal portion of a transverse frame of the panel.
Figure 10:
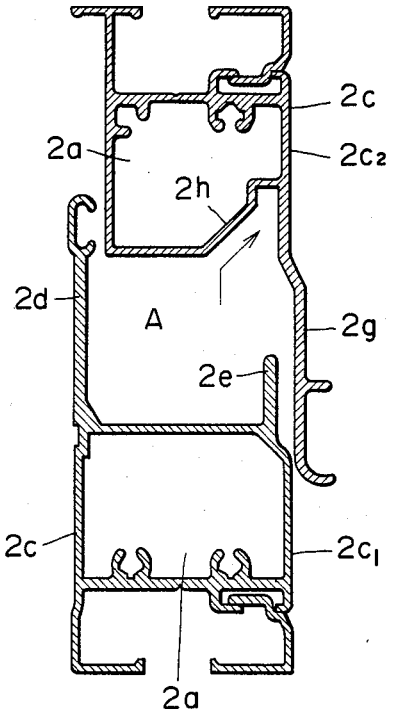

More specifically, in the case where the panels are folded and stored on the indoor side, the upper frame $2c_1$ of the transverse frame 2c is formed with upwardly extending upper frame extensions 2d and 2e as shown in FIGS. 7, 9 and 10. To the top of the outdoor-side upper frame extension 2d is attached an airtight member 2f made of, for example, a soft polyvinyl chloride, whereby airtightness is provided in addition to protection against rain.

On the other hand, the lower frame $2c_2$ of the adjacent panel 2 is formed with a downwardly extending lower frame estension 2g on the indoor side, and in the vicinity of the root of the lower frame extension 2g is formed an inclined concave portion 2h for guiding the indoor-side upper frame extension 2e as indicated with the arrow and insuring engagement of the upper and lower frames $2c_1$ and $2c_2$ with each other.

Therefore, in a closed state of the shutter in which the panels 2 are supported by guide rails (not shown), the panels 2 are in close contact with each other without leaving gap therebetween, and also during their opening and closing motions, the upper and lower frames of the panels 2 assume a state of overlap with each other and allow no gap to be formed when viewed from the front, thus providing a nice-looking appearance, as shown in FIG. 9. Moreover, during the closing motion of the panel 2, since the lower frame $2c_2$ is formed with the inclined concave portion 2h, the upper frame extension 2e is guided to a predetermined engaging posiion by the inclined concave portion 2h, whereby it is made possible to prevent an inexact engagement of both frames $2c_1$ and $2c_2$ caused by deformations (deflection, torsion, etc.) of the frame material, and besides, the engagement of both frames $2c_1$ and $2c_2$ can be made firm.

Further, even if a gap A is formed between the panels 2 as shown in FIG. 10, the gap A is shielded as shown in FIG. 10 by the extensions 2d, 2e and 2g of the upper and lower frames $2c_1$ and $2c_2$. Therefore, there is no fear of a foreign matter getting in the gap A and causing trouble with the shutter device or a part of the human body such as a finger being caught in this gap. Moreover, in the closing operation, if the operation is stopped when the bottom panel 2 alone comes into contact with the floor surface, the state between the panels 2 becomes like FIG. 10, thus also permitting a slight ventilation.

From both upper sides of the frame 2a of the panel 2 there project pins 21 which are inserted in and engaged with the driving chains 3 rotatably and movably in the thrust direction. On the other hand, at both lower sides the panel rollers 22 adapted to move in abutment with the panel guides 11 are attached rotatably to the fore end of a shaft 23.

Figure 8:
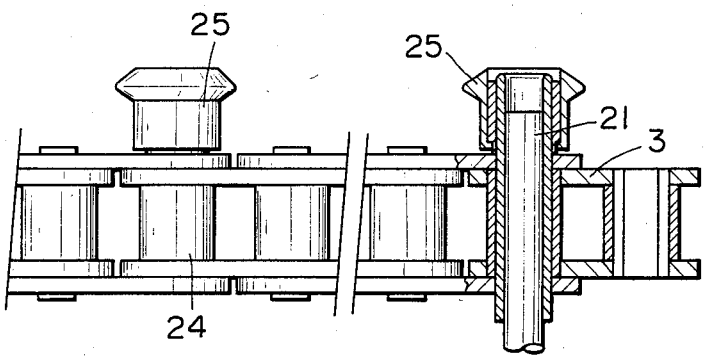
FIG. 8 is a plan view, partly in section, showing connection between the driving chain and the panel.
Figure 6:
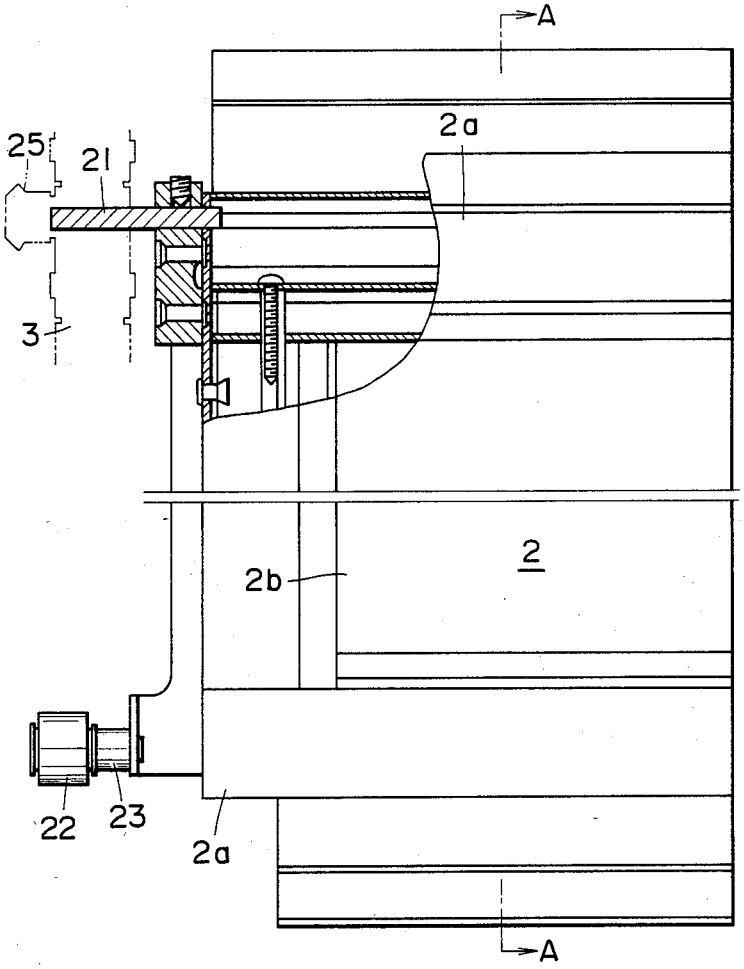
FIG. 6 is a plan view, partly in section, of a panel.

The above engagement of the pin 21 with the chain 3 is made by inserting and engaging the pin 21 into and with an attachment 24 rotatably and movably in the thrust direction, the attachment being provided at predetermined intervals in the driving chain 3, as shown in FIGS. 5, 6 and 8. As a result, the panel 2 moves up and down integrally with the driving chains 3. To the attachments 24 are attached suspending rollers 25, which engage the support rails 4 when stowing the panels 2 and suspend and support the panels 2 in a folded state.

The operation of the present invention will now be described.

The stowing operation for the panels 2 is effected by rotating the sprockets 8, 14, 17 and 18 in the direction of the arrows in FIGS. 1 and 2 by means of the machine 13 to raise the driving chains 3. With upward movement of the driving chains 3, the panels engaged with the chains 3 are successively drawn up integrally with the chains 3, but once the top of the panel 2 reaches the driving sprockets 8, the top portion of the panel 2 performs a circular motion along the pitch circumferences of the sprockets 8 together with the chains 3 and is guided toward the support rails 4. On the other hand, the panel rollers 22 attached to lower end portions of the panel 2 are guided obliquely upwards by the panel guides 11 while rotating and advance into the interior of the storage box 5 in a rolling-prevented state. Thus, the panel 2 smoothly goes away from the moving path of the succeeding panel 2, so the ascent of the succeeding panel 2 is not impeded. Thereafter, the suspensing rollers 25 of the chains 3 engage the support rails 4 and the panel 2 as suspended moves automatically to the interior of the storage box along the downwardly inclined support rails 4. In this case, the abnormal engagement of the chain 3 with the sprocket 8 would cause the chain 3 engaged with the sprocket 8 to contact the chain separating plate 9 which is disposed near the sprocket 8, so that the chain 3 is sure to separate from the sprocket 8 and therefore the above stowing operation can be effected extremely smoothly, In stowing, the driving chains 3 move in the storage box 5 together with the panel 2 without entwinement along the chain top guiding rod 6, and when the panels 2 are stowed in a folded state, the chains 3 are stowed meanderingly and regularly on the sides of the panels as shown in FIG. 1. Such a series of operations are repeated every time the succeeding panel 2 approaches the support rails 4.

Conversely, in the delivery of the panels 2, the drive portion 12 is reverse-rotated for delivery of the driving chain 3, whereby the panels 2 are successively drawn out reversely to the foregoing operation. In this case, the other chain separating plate 10 provided near the sprocket 8 allows the chain 3 to pass the sprocket 8 smoothly. In the event of overlapping or squeezing of the panels 2 in the guide rails 1, the panels 2 become immovable, and if this condition is left as it is, it will cause a serious accident. In this case, however, since the chain 3 bends, this bending force displaces the plate 7a of the sensor 7, thus operating the limit switch 7b. Consequently, it is possible to immediately become aware of an abnormal overlapping or squeezing of the panels 2 and stop the movement of the panels.

Moreover, since the rollers 22 are guided toward the guide rails 1 by the panel guides 11, the panel 2 is guided smoothly to the moving path along the guide rails 1.

Further, the tops of the chains 3 which drive the panel 2 are fitted on the chain top guiding rods 6 loosely movably and do not hand down or become entangled during stowing of the panels 2, thus preventing trouble.

According to the present invention, as set forth hereinabove, since the panel is directly engaged with the driving chains rotatably and movably in the thrust direction, the ascending and descending motions of the panel 2 can be effected easily and surely. Besides, since the moving direction of the panel 2 and the acting force direction in the ascending and descending motions of the panel 2 can approximately be made coincident with each other, the acting force can be utilized extremely efficiently as an opening and closing force of the panel 2, thus permitting smooth and sure operations.

Moreover, by the sensor 7 it is made possible to immediately become aware of overlapping or squeezing of the panels in the guide rails 1. Besides, since the panel guides 11 are provided near the entrance of the storage box 5, the stowing and delivery operations for the panel 2 can be done surely and smoothly, that is, an efficient opening and closing of the shutter device can be attained.

Further, since the occurrence of an improper engagement is prevented by the chain-sprocket disengaging plates 9 and 10, the ascending and descending motions of the panel 2 can be effected smoothly and efficiently, and the chain 3 does not get entangled during stowing of the panels, thus preventing an accident.

Additionally, since the panel 2 has the special shapes at end portions, the engagement between adjacent panels 2 can be done smoothly and surely during closure of the shutter, and it can be made firm. Besides, the gap between the panels 2 is shielded, so the trouble caused by entry of a foreign matter into the gap or a human accident can be prevented. Thus, extremely superior effects are attained.

INDUSTRIAL UTILIZABILITY

As set forth hereinabove, the shutter device of the present invention is useful for portions which require opening and closing such as garages, show windows and other windows.

What is claimed is:

1. A shutter device for opening and closing an opening such as a building gateway, window or the like comprising means for moving up and down a plurality of panels which are engaged with guide rails disposed on both sides of said opening, part of each said panel being engaged with panel lift means to effect opening and closing motions of the panels, support rails for said panels disposed above said guide rails, and means for guiding said panels into positions where said panels are suspended from said support rails, each of said panels including upper and lower portions and pins projecting from said upper portions, said pins being inserted in attachments provided in predetermined positions on said panel lift means, said pins and said attachments being engaged together rotatably and movably in the thrust direction, said panel lift means comprising chains disposed on opposite sides of said opening, and further including sprockets disposed near the upper portions of said guide rails for engaging said chains to drive said chains, and chain-sprocket disengaging plates disposed adjacent the teeth of said sprockets for positively separating said chains from said sprockets during opening motion of said panels, each of said panels including an upper frame and a lower frame, each of said upper frames including a first extension projecting upwardly, each of said lower frames includes a second extension projecting downwardly, said first extension of one panel extending in overlapping relation with said second extension of an adjacent panel to enclose a gap between said adjacent panels.

2. The shutter device as set forth in claim 1, wherein a sensor is disposed laterally one of said chains of said panel lift means near the corresponding guide rail, said sensor sensing lateral displacement of said one of said chains occurring upon jamming of panels in said guide rails.

3. The shutter device as set forth in claim 1 or 2, wherein rollers are attached to lower end of each of said panels, panel guides are disposed in predetermined positions on said guide rails, said panel guides are directed obliquely upward toward said support rails and said rollers engage said panel guides and move therealong, thereby guiding said panel toward said support rails.

* * * * *